US012123642B2

(12) United States Patent
Pasham et al.

(10) Patent No.: US 12,123,642 B2
(45) Date of Patent: Oct. 22, 2024

(54) SYSTEMS FOR INTERNAL REFRIGERATOR ORGANIZATION

(71) Applicant: Haier US Appliance Solutions, Inc., Wilmington, DE (US)

(72) Inventors: Srinivas Pasham, Hyderabad (IN); Rukmini Harika Relangi, Hyderabad (IN); Avishrant Kamble, Hyderabad (IN); Ashok Kumar Adari, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 163 days.

(21) Appl. No.: 17/873,435

(22) Filed: Jul. 26, 2022

(65) Prior Publication Data

US 2023/0400248 A1 Dec. 14, 2023

(30) Foreign Application Priority Data

Jun. 10, 2022 (IN) ..... 202211033294

(51) Int. Cl.

| | |
|---|---|
| ***F25D 25/02*** | (2006.01) |
| ***A47B 77/16*** | (2006.01) |
| ***A47B 88/42*** | (2017.01) |
| ***A47B 96/02*** | (2006.01) |
| ***A47B 96/06*** | (2006.01) |
| *A47B 46/00* | (2006.01) |
| *A47B 81/00* | (2006.01) |

(52) U.S. Cl.

CPC ..... *F25D 25/024* (2013.01); *A47B 88/42* (2017.01); *A47B 96/061* (2013.01); *F25D 25/021* (2013.01); *A47B 46/00* (2013.01); *A47B 77/16* (2013.01); *A47B 81/00* (2013.01); *A47B 2210/0062* (2013.01); *F25D 25/027* (2013.01)

(58) Field of Classification Search

CPC .... F25D 25/025; F25D 25/024; F25D 25/027; F25D 25/021; F25D 25/02; A47B 88/42; A47B 96/025; A47B 77/10; A47B 77/16; A47B 96/061; A47B 81/00; A47B 46/00; A47B 2210/0062; A47F 3/06

See application file for complete search history.

(56) References Cited

U.S. PATENT DOCUMENTS

| | | | | |
|---|---|---|---|---|
| 2,840,438 | A | 6/1958 | Sharpe | |
| 5,127,721 | A * | 7/1992 | Inden | A47B 46/00 312/249.9 |
| 5,671,987 | A * | 9/1997 | Hommes | A47B 88/42 312/234.5 |
| 8,182,056 | B2 * | 5/2012 | Gossens | A47B 96/061 312/408 |
| 8,267,493 | B2 | 9/2012 | Kim | |
| 8,950,836 | B2 | 2/2015 | Kim et al. | |
| 11,892,231 | B2 * | 2/2024 | Pasham | F25D 25/00 |

(Continued)

*Primary Examiner* — Kimberley S Wright
(74) *Attorney, Agent, or Firm* — Dority & Manning, P.A.

(57) ABSTRACT

In an example embodiment, a refrigerator a cabinet having slotted rail. The cabinet defines a food storage chamber. Also, a door is coupled to the cabinet and is configured to open and close the food storage chamber. Additionally, a shelf is mounted inside the food storage chamber, and a rack is positioned central in the food storage chamber proximate the shelf. The rack includes a back support, a slider coupled to the back support, and a knob coupling the rack to the slider.

19 Claims, 5 Drawing Sheets

(56) References Cited

U.S. PATENT DOCUMENTS

| | | | | |
|---|---|---|---|---|
| 2004/0232810 | A1 | 11/2004 | Kreyenkamp | |
| 2006/0163984 | A1 | 7/2006 | Andersen | |
| 2009/0058248 | A1* | 3/2009 | Gossens | F25D 25/024 211/90.02 |
| 2011/0083465 | A1* | 4/2011 | Kim | F25D 25/027 62/449 |
| 2013/0264932 | A1* | 10/2013 | Kim | F25D 23/028 312/405 |
| 2013/0278127 | A1* | 10/2013 | Kim | F25D 25/025 312/405 |
| 2016/0007744 | A1* | 1/2016 | Fasino | A47F 5/0087 211/85.5 |
| 2018/0087828 | A1* | 3/2018 | Park | F25D 25/02 |
| 2022/0404092 | A1* | 12/2022 | Pasham | F25D 25/00 |

* cited by examiner

SYSTEMS FOR INTERNAL REFRIGERATOR ORGANIZATION

PRIORITY INFORMATION

The present application claims priority to Indian Provisional Patent Application Number 202211033294 filed on Jun. 10, 2022.

FIELD OF THE INVENTION

The present subject matter relates generally to organizational systems within refrigerator appliances, for example racks and shelves.

BACKGROUND OF THE INVENTION

The primary function of a refrigerator is to store perishable food items, such as meat, fish, vegetables, fruits, and beverages, to allow the perishable food items to maintain a fresh state. Generally, a refrigerator includes a refrigeration system cooling one or more storage chambers, such as a freezing chamber and a fresh-food chamber. Doors are disposed at one or more sides of the refrigerator body and are configured to open and close the storage chambers. In order to effectively utilize the storage chambers inside the refrigerator, numerous shelves are typically mounted inside of the storage chambers so as to accommodate storage of items thereon.

A door storage, such as a basket having storage products kept therein, can be disposed on a rear surface of the door. In the refrigerator, a large quantity of storage products can be kept in the storage of the storage chamber. As the depth of the storage chamber increases, a larger quantity of storage products can be kept in the storage of the storage chamber. When the door of the refrigerator is opened, the storage of the storage chamber is positioned inside the storage chamber, and the door storage is moved to the outside of the storage chamber so as to be viewed together with the storage of the storage chamber from the outside. A user can keep storage products in the storage of the storage chamber and the door storage according to the sizes or kinds of storage products. Due to sizes and shapes of objects being put into the storage chamber, unusable space can be created in the storage chambers, often referred to as dead space.

BRIEF DESCRIPTION OF THE INVENTION

Aspects and advantages of the invention will be set forth in part in the following description, or may be apparent from the description, or may be learned through practice of the invention.

In an example embodiment, a refrigerator defining a vertical direction, a lateral direction, and a transverse direction. The vertical, lateral, and transverse directions are mutually perpendicular. The refrigerator includes a cabinet having a slotted rail, and the cabinet defines a food storage chamber. The refrigerator also has a door coupled to the cabinet and is configured to open and close the food storage chamber. Additionally, a shelf is mounted inside the food storage chamber, and a rack is positioned laterally centered in the food storage chamber proximate the shelf. The rack includes a back support, a slider coupled to the back support, and a knob coupling the rack to the slider.

In another example embodiment, an appliance includes a storage chamber with a slotted rail in the storage chamber. Also included is a shelf mounted in the storage chamber and a rack positioned laterally centered in the storage chamber proximate the shelf. The rack includes a back support, a slider coupled to the back support, and a knob coupling the rack to the slider.

In another example embodiment, a rack is in an appliance. The rack includes a back support, a slider coupled to the back support, and a knob that couples the rack to the slider.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
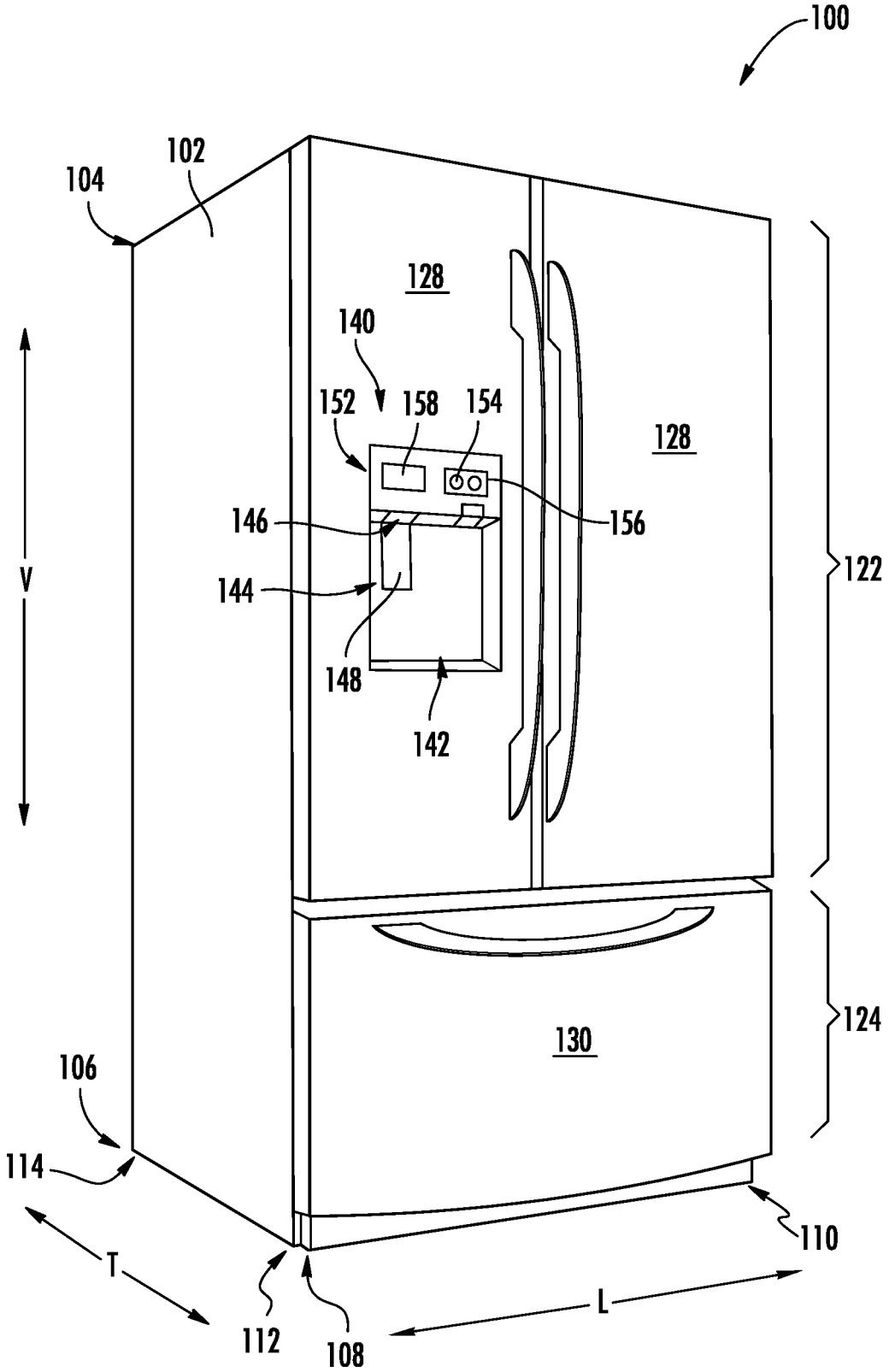
FIG. 1 is a perspective view of a refrigerator appliance according to an example embodiment of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

Figure 2:
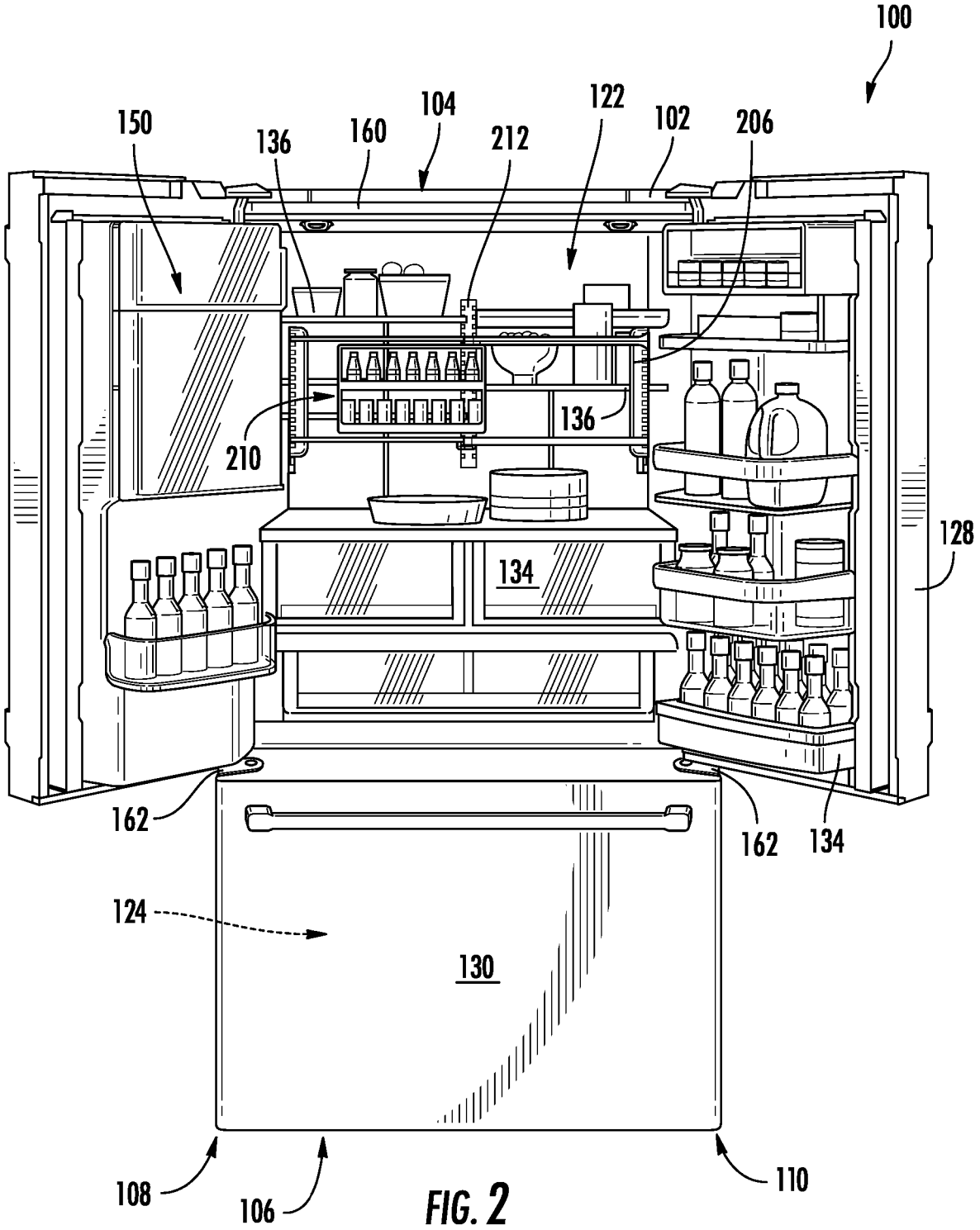
FIG. 2 is a perspective view of the example refrigerator appliance of FIG. 1 with doors shown in an open configuration.

Referring now to the figures, an example appliance will be described in accordance with example aspects of the present subject matter. Specifically, FIG. 1 provides a perspective view of an example refrigerator appliance 100, and FIG. 2 illustrates refrigerator appliance 100 with some of the doors in the open position. As illustrated, refrigerator appliance 100 generally defines a vertical direction V, a lateral direction L, and a transverse direction T that are mutually perpendicular and form an orthogonal coordinate system.

According to example embodiments, refrigerator appliance 100 includes a cabinet 102 that is generally configured for containing and/or supporting various components of refrigerator appliance 100 and which may also define one or more internal chambers or compartments of refrigerator appliance 100. In this regard, as used herein, the terms "cabinet," "housing," and the like are generally intended to refer to an outer frame or support structure for refrigerator appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of refrigerator appliance 100. By contrast, cabinet 102 may enclose some or all portions of an interior of cabinet 102. It should be appreciated that cabinet 102 may have any suitable size, shape, and configuration while remaining within the scope of the present subject matter.

As illustrated, cabinet 102 generally extends between a top portion 104 and a bottom portion 106 along the vertical direction V, between a first side portion 108 (e.g., the left side when viewed from the front as in FIG. 1) and a second side portion 110 (e.g., the right side when viewed from the front as in FIG. 1) along the lateral direction L, and between a front portion 112 and a rear portion 114 along the transverse direction T. In general, terms such as "left," "right," "front," "rear," "top," or "bottom" are used with reference to the perspective of a user accessing refrigerator appliance 100. As shown in FIG. 2, cabinet 102 may include a top wall 160 and a pair of side walls 162, e.g., that are spaced apart along the lateral direction L.

Cabinet 102 defines chilled chambers for receipt of food items for storage. In particular, cabinet 102 defines fresh food chamber 122 positioned at or adjacent top portion 104 of cabinet 102 and a freezer chamber 124 arranged at or adjacent bottom portion 106 of cabinet 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance. Moreover, aspects of the present subject matter may be applied to other appliances as well. Consequently, the description set forth herein is for illustrative purposes only and is not intended to be limiting in any aspect to any particular appliance or configuration.

Refrigerator doors 128 are rotatably hinged to an edge of cabinet 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. In general, refrigerator doors 128 form a seal over a front opening 132 defined by cabinet 102. In this regard, a user may place items within fresh food chamber 122 through front opening 132 when refrigerator doors 128 are open and may then close refrigerator doors 128 to facilitate climate control. Refrigerator doors 128 and freezer door 130 are shown in the closed configuration in FIG. 1. One skilled in the art will appreciate that other chamber and door configurations are possible and within the scope of the present invention.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include pans 134 and shelves 136. Each of these storage components are configured for receipt of food items (e.g., beverages and/or solid food items) and may assist with organizing such food items. As illustrated, pans 134 may be mounted on refrigerator doors 128, referred to then as bins, or may slide into a receiving space in fresh food chamber 122. It should be appreciated that the illustrated storage components are used only for the purpose of explanation and that other storage components may be used and may have different sizes, shapes, and configurations.

Turning back to FIG. 1, a dispensing assembly 140 is generally configured for dispensing liquid water and/or ice. Dispensing assembly 140 and its various components may be positioned at least in part within a dispenser recess 142 defined on one of refrigerator doors 128. In this regard, dispenser recess 142 is defined on a front portion 112 of refrigerator appliance 100 such that a user may operate dispensing assembly 140 without opening refrigerator door 128. In addition, dispenser recess 142 is positioned at a predetermined elevation convenient for a user to access ice and enabling the user to access ice without the need to bend-over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142. By contrast, refrigerator door 128 may define an icebox compartment 150 (FIG. 2) housing an icemaker and an ice storage bin (not shown) that are configured to supply ice to dispenser recess 142.

A control panel 152 is provided for controlling the mode of operation. For example, control panel 152 includes one or more selector inputs 154, such as knobs, buttons, touch-screen interfaces, etc., such as a water dispensing button and an ice-dispensing button, for selecting a desired mode of operation such as crushed or non-crushed ice. In addition, inputs 154 may be used to specify a fill volume or method of operating dispensing assembly 140. In this regard, inputs 154 may be in communication with a processing device or controller 156. Signals generated in controller 156 operate refrigerator appliance 100 and dispensing assembly 140 in response to selector inputs 154. Additionally, a display 158, such as an indicator light or a screen, may be provided on control panel 152. Display 158 may be in communication with controller 156, and may display information in response to signals from controller 156.

As used herein, "processing device" or "controller" may refer to one or more microprocessors or semiconductor devices and is not restricted necessarily to a single element. The processing device can be programmed to operate refrigerator appliance 100, dispensing assembly 140 and other components of refrigerator appliance 100. The processing device may include, or be associated with, one or more memory elements (e.g., non-transitory storage media). In some such embodiments, the memory elements include electrically erasable, programmable read only memory (EEPROM). Generally, the memory elements can store information accessible by a processing device, including instructions that can be executed by processing device. Optionally, the instructions can be software or any set of instructions and/or data that when executed by the processing device, cause the processing device to perform operations.

As shown in FIG. 2, inside fresh food chamber 122, shelves 136 may be mounted to slotted rail 206 and/or twin-slot rail 212. A rack system 210 (FIG. 3) is positioned laterally centered in refrigerator appliance 100 mounted on twin-slot rail 212. As an example, shelves 136 may be used to store food items, and rack system 210 may be used to store containers, e.g., milk bottles, milk cartons, beverage cans, sauce jars, perishable spices, etc.

Figure 3:
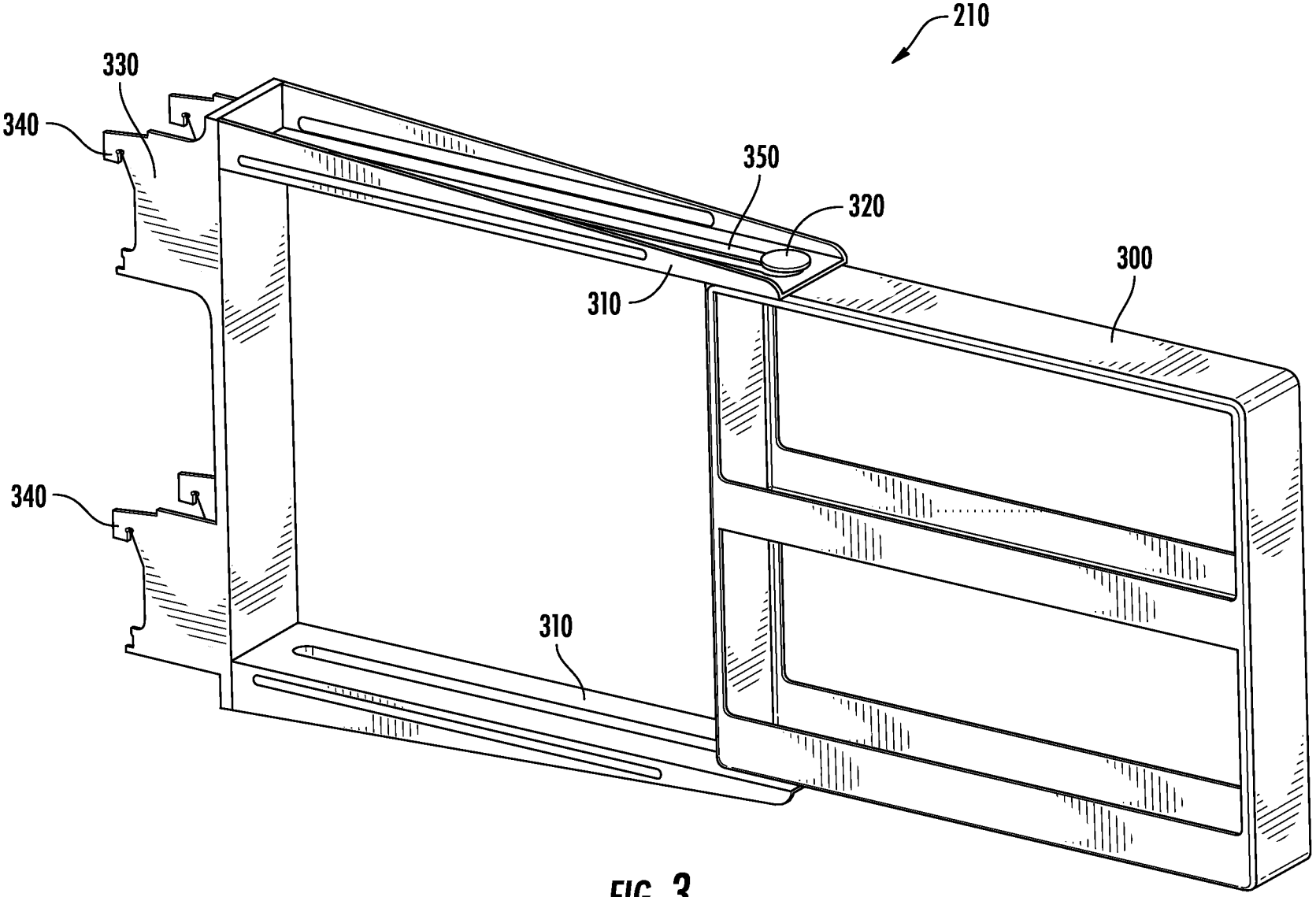
FIG. 3 is a perspective view of a rack system shown in FIG. 2 and according to an example embodiment of the present disclosure.

In an example embodiment, FIG. 3 depicts rack system 210 with a double-tiered rack 300. The double-tiered rack 300 may mount to slider 310 via knob 320. Knob 320 may be a bolt or screw used to couple rack 300 to slider 310 while allowing the translation of rack 300 as well as rotation at one end of slider 310. Back support 330 may include two pair of hooks 340 for stability in refrigerator appliance 100. Hooks 340 mount to twin-slot rail 212. For instance, each of hooks 340 may be received within a respective slot on twin-slot rail 212. Slider 310 includes slot 350, which knob 320 may slide along. Slot 350 may extend longitudinally along the transverse direction T on slider 310. For instance, a length of slot along the transverse direction T may be about equal to a length of slider 310 along the transverse direction T. Moreover, the length of slot along the transverse direction T may be no less than twelve inches (12") and no greater than twenty-eight inches (28") in certain example embodiments.

Pushing or pulling rack 300 may slide knob 320 within slot 350 along slider 310 and may position rack 300 in a retracted or extended position. When knob 320 is pushed toward back support 330, rack 300 may be in the retracted position. Knob 320 may restrict the rotation of rack 300 while in the retracted position. When knob 320 is pulled towards the distal end portion of slider 310, furthest from back support 330, then rack 300 may be in the extended position and knob 320 acts such that rack 300 may rotate about the vertical axis at knob 320.

Figure 4:
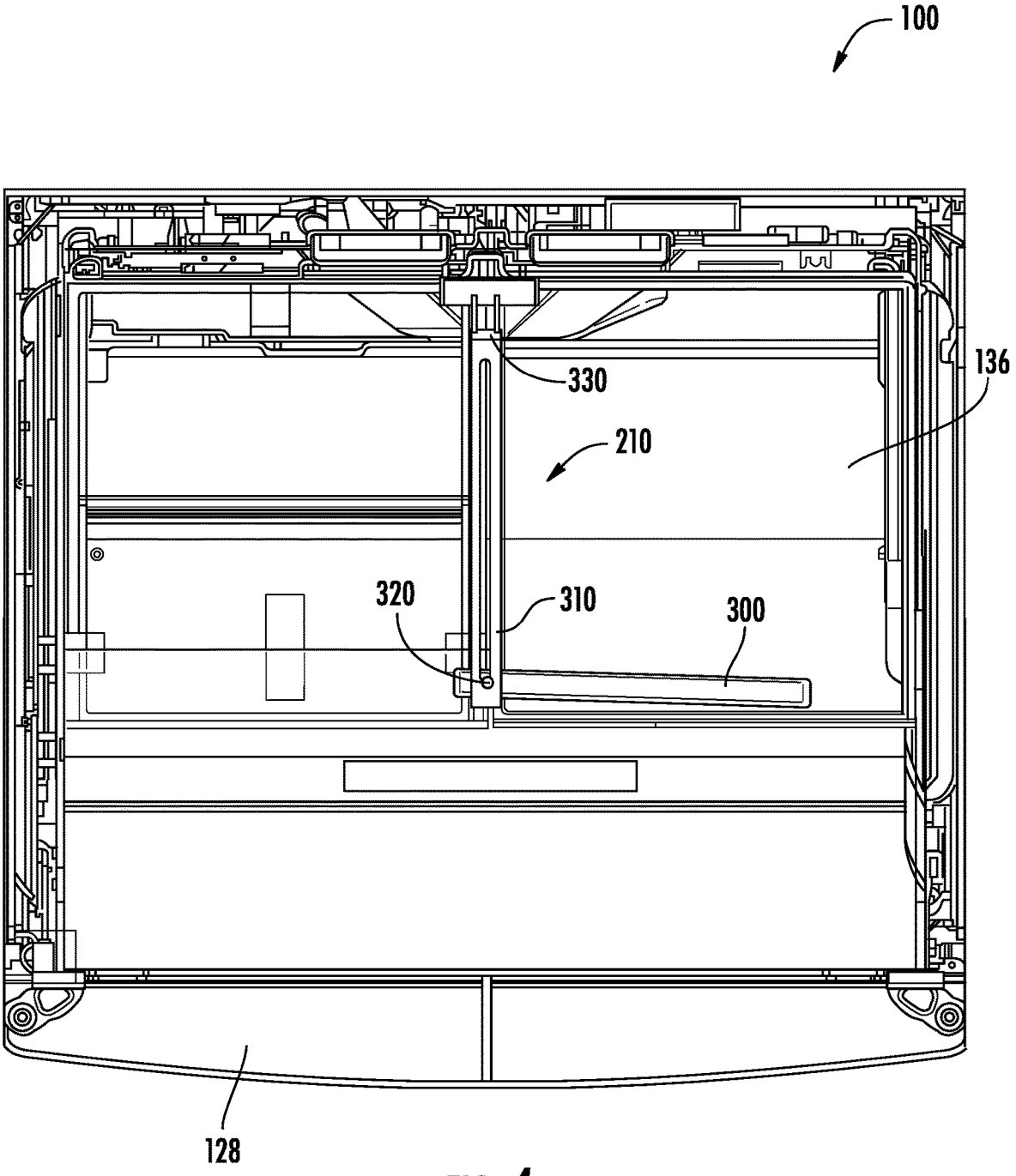
FIG. 4 is a top-down section view of the rack system in the example refrigerator appliance of FIG. 1.

FIG. 4 demonstrates a top-down view of rack system 210 in example refrigerator appliance 100. Rack system 210 is shown in the extended position and rotated. The ability for rack system 210 to move between positions and rotate may create an opportunity for a user to organize the contents of refrigerator appliance 100. In the present embodiment, rack 300 is shown, however one of skill in the art would understand other racks of similar shape may be used in rack system 210 and that rack 300 is provided by way of example only.

Figure 5:
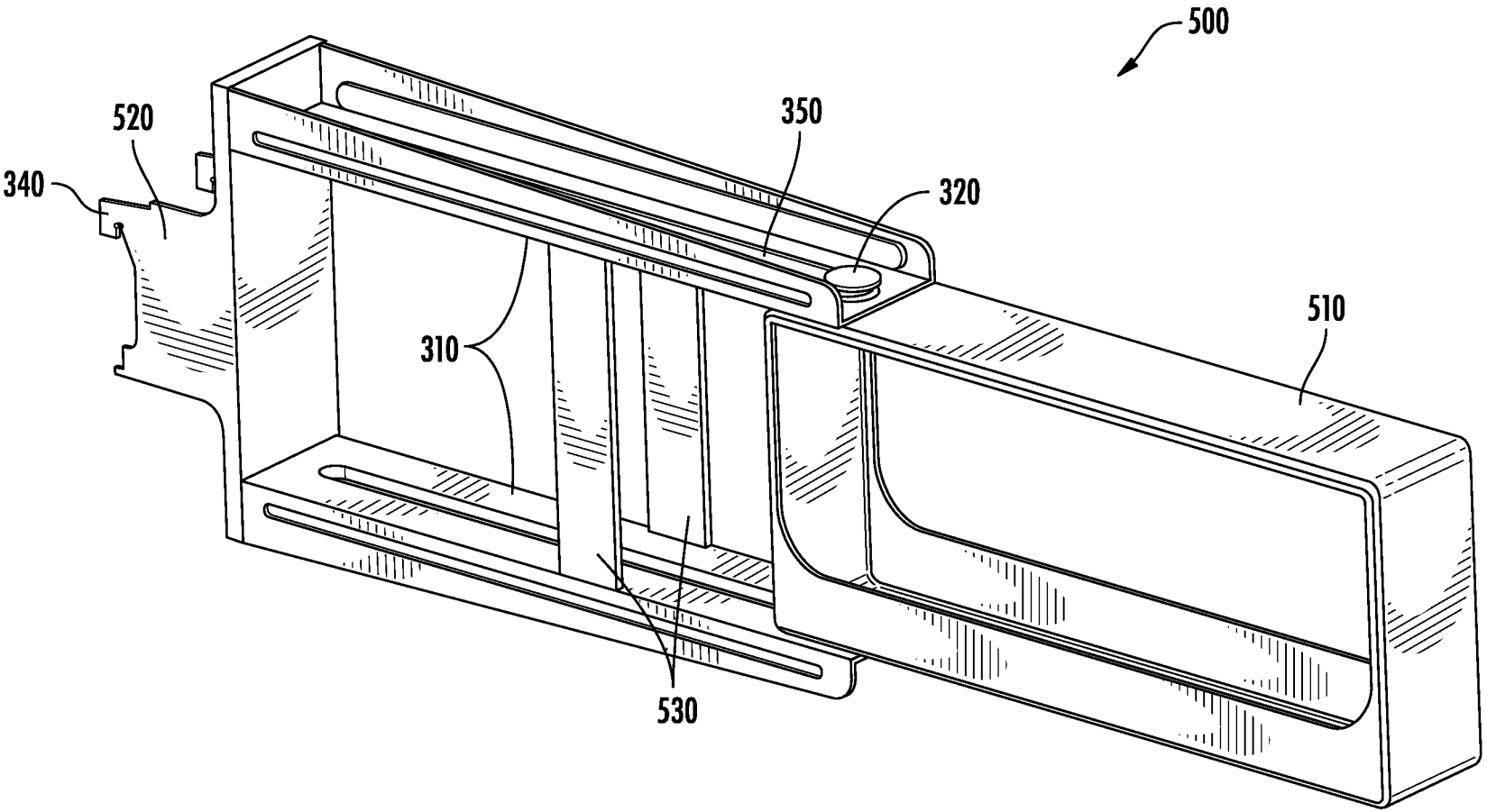
FIG. 5 is a perspective view of an alternate example embodiment of the rack system shown in FIG. 3.

As seen in FIG. 5, another example embodiment depicts a single-tiered rack system 500. The single-tiered rack system 500 operates identically to the double-tiered rack system 210. Single-tiered rack system 500 utilizes rack 510, which is mounted to slider 310 with slot 350 via knob 320. Back support 520 may be used in the single-tiered rack system 500, because one pair of hooks 340 is sufficient to hold the rack in place. For added rigidity, multiple support arms 530 may be coupled to slider 310 in single-tiered rack system 500. Pushing or pulling rack 510 may slide knob 320 along slider 310 and may position rack 510 in a retracted or extended position. When rack 510 is pushed and knob 320 is pushed toward back support 520, rack 510 may be in the retracted position. When knob 320 is pulled to the furthest end of slider 310 from back support 520, then rack 510 may be in the extended position and may rotate about the vertical axis at knob 320.

As may be seen from the above, rack system 210 allows a user to align items in a refrigerator appliance 100. Rack system 210 allows the user to organize portions of fresh food chamber 122 with food items and rack system 210 with containers such as milk bottles, milk cartons, beverage cans, sauce jars, perishable spices, etc. Since rack system 210 provides the ability for containers to be stored in rack system 210, other items, such as bulkier items, may be able to be stored in other portions of refrigerator appliance 100, thus using the available space within fresh food chamber 122.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator, comprising:

a cabinet having a slotted rail, the cabinet defining a fresh food chamber, the slotted rail positioned within the fresh food chamber proximate a rear portion of the cabinet;

a door coupled to the cabinet and configured to open and close the fresh food chamber;

a shelf mounted on the slotted rail within the fresh food chamber; and a rack assembly positioned laterally centered in the fresh food chamber proximate the shelf, the rack assembly comprising a back support positioned at the rear portion of the cabinet, a slider coupled to the back support and cantilevered away from the back support, a rack body having at least one tier configured for supporting articles, and a knob coupling the rack body to the slider.

2. The refrigerator as in claim 1, wherein the refrigerator type is one of a top-mount refrigerator, bottom-mount refrigerator, and side-by-side refrigerator.

3. The refrigerator as in claim 1, wherein the back support of the rack assembly mounts the rack assembly onto the slotted rail.

4. The refrigerator as in claim 1, wherein the rack body is single-tiered or double-tiered.

5. The refrigerator as in claim 1, wherein the rack body is translatable along a length of the slider.

6. The refrigerator as in claim 1, wherein the rack body is rotatable about a vertical axis at a distal end portion of the slider.

7. The refrigerator as in claim 1, wherein the knobs is one of a bolt and a screw.

8. An appliance comprising:

a storage chamber;

a slotted rail in the storage chamber the slotted rail positioned within the fresh food chamber proximate a rear portion of the cabinet;

a shelf mounted to the slotted rail in the storage chamber;

a rack assembly positioned laterally centered in the storage chamber proximate the shelf, the rack assembly comprising, a back support positioned at the rear portion of the storage chamber, a slider coupled to the back support and cantilevered away from the back support, a rack body having at least one tier configured for supporting articles, and a knob coupling the rack body to the slider.

9. The appliance as in claim 8, wherein the back support of the rack assembly mounts the rack assembly onto the slotted rail.

10. The appliance as in claim 8, wherein the rack body is single or double tiered.

11. The appliance as in claim 8, wherein the rack body is translatable along the length of the slider.

12. The appliance as in claim 8, wherein the rack body is rotatable about a vertical axis at a distal end portion of the slider.

13. The appliance as in claim 8, wherein the knobs is one of a bolt and a screw.

14. A rack assembly configured to be positioned in an appliance, the rack assembly comprising:

a back support configured to be positioned within the appliance;

a slider coupled to the back support and cantilevered away from the back support;

a rack body having at least one tier configured for supporting articles; and a knob coupling the rack body to the slider.

15. The rack assembly as in claim 14, wherein the appliance is a refrigerator, freezer, or a combination thereof.

16. The rack assembly as in claim 14, wherein the back support mounts to a rear portion within the appliance.

17. The rack assembly as in claim 14, wherein the rack body is single or double tiered.

18. The rack assembly as in claim 14, wherein the rack body is translatable along the length of the slider.

19. The rack assembly as in claim 14, wherein the rack body is rotatable about a vertical axis at a distal end portion of the slider.

* * * * *